United States Patent [19]

Anemaet

[11] Patent Number: 4,870,251

[45] Date of Patent: Sep. 26, 1989

[54] EXTERNAL HEATING OF TRANSFER PADS

[75] Inventor: John M. Anemaet, Millis, Mass.

[73] Assignee: Dennison Manufacturing Company, Framingham, Mass.

[21] Appl. No.: 793,875

[22] Filed: Nov. 1, 1985

[51] Int. Cl.[4] ..... H05B 1/00; H05B 3/06; B02C 11/08; B30B 15/34

[52] U.S. Cl. ..... 219/243; 219/457; 219/540; 156/493; 156/583.3; 100/93 P

[58] Field of Search ..... 156/359, 358, 361, 488, 156/493, 583.3, 583.4, 583.91, 583.1, 540, 541, 542; 100/211, 296, 93 P; 219/243, 540, 462, 464, 447, 457

[56] References Cited

U.S. PATENT DOCUMENTS

| | | | |
|---|---|---|---|
| 1,977,731 | 10/1934 | Masury | 156/359 |
| 2,082,551 | 6/1937 | Raney | 100/93 P |
| 3,029,178 | 4/1962 | Carver | 156/359 |
| 3,660,208 | 5/1972 | Hubbard | 156/359 |
| 3,703,427 | 11/1972 | Sellers et al. | 156/583.3 |
| 3,867,226 | 2/1975 | Guido et al. | 219/243 |
| 4,016,021 | 4/1977 | La Fleur | 219/243 |
| 4,511,425 | 4/1985 | Boyd et al. | 156/542 |

*Primary Examiner*—Michael W. Ball
*Assistant Examiner*—Louis Falasco
*Attorney, Agent, or Firm*—Gary S. Winer; George E. Kersey

[57] ABSTRACT

A heat transfer pad molded over elongated projections, such as bolts, to conduct heat to the pad interior, and securely maintain the pad on a support. A heater assembly slideably retains the pad and support, and includes replaceable heating elements, which are insulated from a mounting assembly.

15 Claims, 4 Drawing Sheets

EXTERNAL HEATING OF TRANSFER PADS

BACKGROUND OF THE INVENTION

The invention relates to heat transfer decorating, and more particularly to heating of a heat transfer pad.

A heat transfer pad and apparatus are shown in commonly assigned U.S. Pat. No. 4,511,425 to Boyd et al. The pad is heated by a heating element disposed within a silicone pad. The heating element is placed within the mold before the liquid silicone compound is added. The reference teaches that a flexible heating element is preferred, in that unduly stiff elements might interfere with the flexure of the pad. Wires extend through the pad backing to conduct electricity to the element.

While this method of heating the pad functions well, it has been found that the heating element has a limited life, particularly due to the high degree of flexing to which the flexible element is subjected. When the element expires, the pad is discarded, necessitating removal of the pad and its support from the decorating apparatus, and the installation of a new pad.

Accordingly, it is an object of the invention to provide for the heating of a heat transfer pad.

It is an additional object to provide for replacement of the heating element without the requirement of replacing the pad, and without having to remove the pad from the decorating apparatus.

It is a further object of the invention to provide a heating configuration which is highly resistant to wear, and which does not interfere with decoration by the pad.

SUMMARY OF THE INVENTION

Apparatus for heat transfer labelling includes a heat conducting substrate having a plurality of heat conducting projections, such as bolts, over which an elastomeric pad is molded. The substrate is slideably retained by a heater assembly.

In accordance with one aspect of the invention, a plurality of heat generating units, such as cylindrical electric heating elements, are disposed within holes in the heater assembly.

In accordance with another aspect of the invention, the elastomeric pad is formed from a compound which resists heat degredation, such as silicone. Liquid compound, typically containing a plasticizer, is poured into an aperture in the substrate, the latter disposed over the mold. The pad is partially cured at a lower temperature in the mold, and then fully cured at a higher temperature after removal therefrom.

In accordance with yet another aspect of the invention, the substrate is a metallic plate, preferably fabricated from steel, and has bevelled edges cooperative with mating edges in the heater assembly. As a result, the plate is slideably engaged in close abutting conformity with the heater assembly, and may be easily removed. Set screws maintain the plate in engagement with the heater assembly. In one embodiment, the projections are bolts with enlarged heads.

The heater assembly is typically fabricated from steel, and readily conducts heat. Along with the heating elements discussed above, a temperature sensor is mounted within the assembly. Additionally, a temperature sensor may project from the plate. In accordance with one embodiment of the invention, the heater assembly is contained in a heater block comprising: a mounting assembly having a threaded aperture through which the entire assembly may be mounted; a heat insulating layer in overlaying conformity with the mounting assembly; and the heater assembly as discussed above.

In accordance with a further aspect of the invention, the externally heated pad of the invention is formed by mounting a plurality of elongated projections to a plate. The projections may be staggered to conform to the shape of the mold, thereby permitting the desired flexure of the pad. Liquid silicone compound is poured through a hole in the plate, and is then cured to form a solid pad. The plate with attached pad is then secured to the heater assembly having heat generating elements disposed therein. A heat insulating layer is disposed between the heat generating layer and a separate mounting assembly.

DETAILED DESCRIPTION OF THE INVENTION

Figure 1:
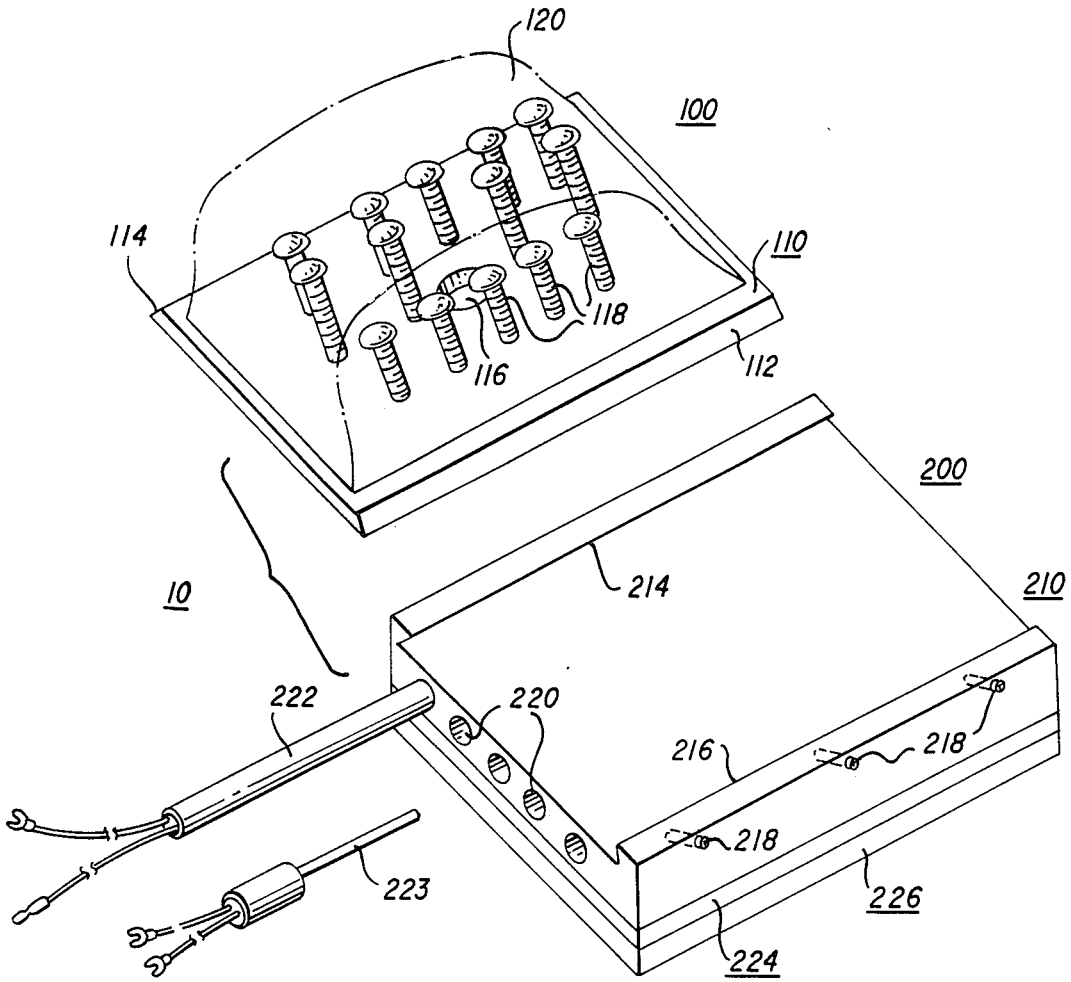
Figure 2:
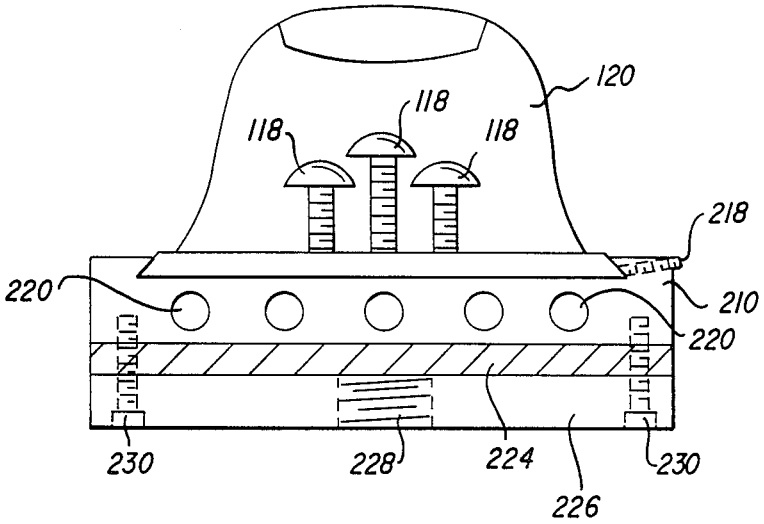
Figure 3:
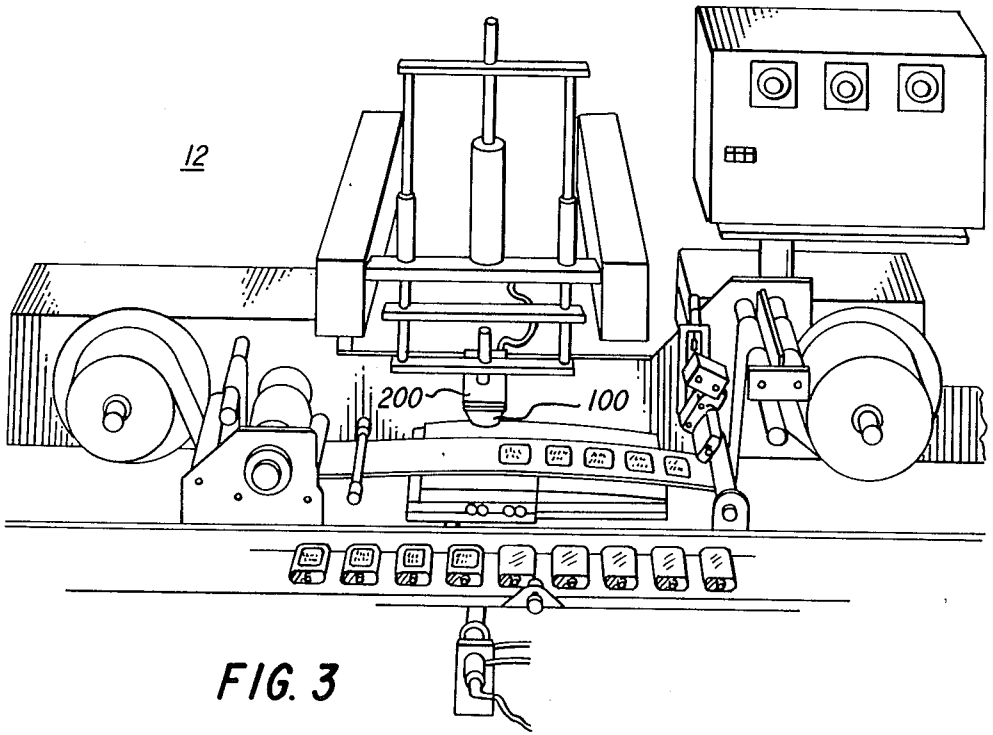
Figure 4:
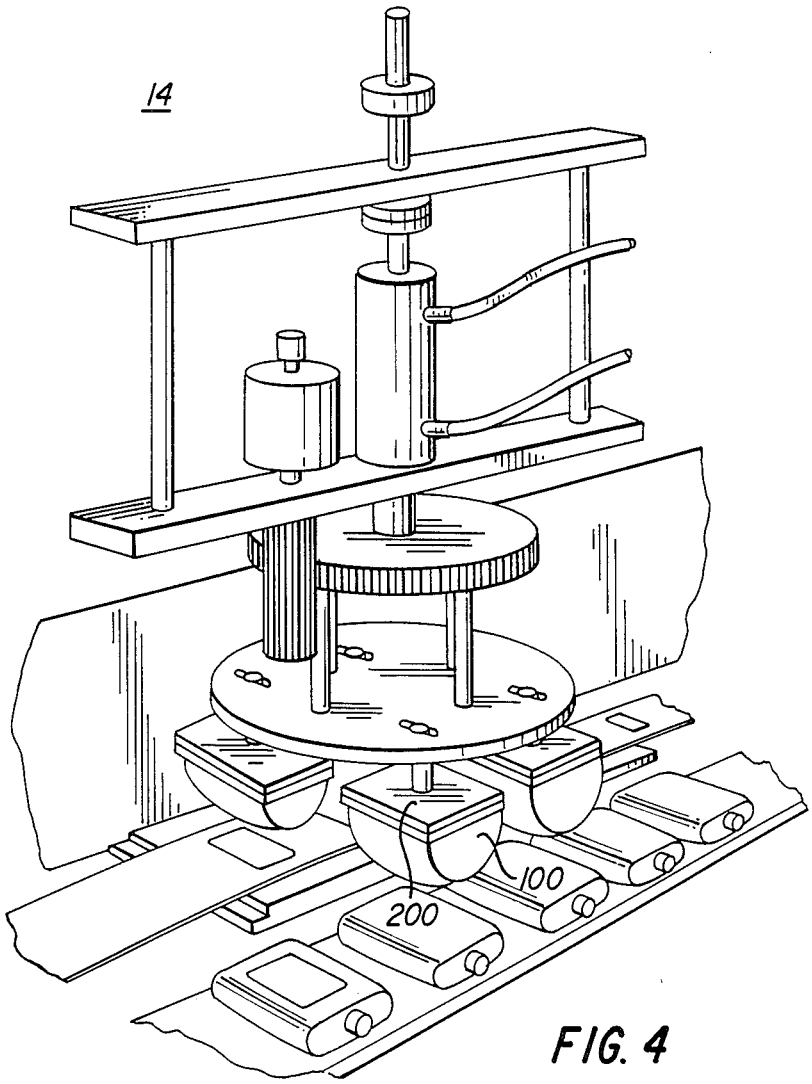

With reference to FIGS. 1–4, a heated pad 10 in accordance with the invention includes a pad assembly 100 and a heater block 200. Together elements 100,200 cooperate in a pad decorator 12 or 14 as shown in FIGS. 3 and 4, such as are described in U.S. Pat. No. 4,511,425. Reference may be had to the cited patent for a description of this labelling equipment generally, as well as the operation of the pad in connection with label transfer.

Pad assembly 100 includes a plate 110 preferably provided with bevelled edges 112, 114, and a fill aperture 116. Plate 110 is rigid and conducts heat readily. In a preferred embodiment, plate 110 is constructed of steel. Elongated projections 118 extend upwardly from plate 110. The projections are heat conducting, and preferably offer a great amount of surface area over which this heat may be transferred to the pad interior, discussed further below. In the embodiment shown in the figures, the projections are bolts with enlarged heads, which are threadably fastened to plate 112. The bolts shown are aligned in three columns, with the central column extending at a greater height than the side columns. This configuration is based on pad 120 shape, and contributes to the even distribution of heat throughout pad 120, as well as secure attachment of pad 120 to plate 112. Moreover, the projection lengths are selected to avoid interference with pad flexure and decoration.

Pad 120 may be formed of a variety of materials, depending on the chemistry of the label to be applied. In a preferred embodiment, the pad is a silicone compound with a plasticizer. Plate 112 is placed over a mold with the projections extending into the mold interior. Liquid silicone compound is poured into the mold through aperture 116. The silicone is subsequently cured at various elevated temperatures until the pad has the desired physical properties, including durometric value. Projections 118 promote the adhesion of the cured silicone to plate 112. This is of particular importance, since pad 120 and plate 112 will be subject to great stress during decoration.

Heater block 200 includes heater assembly 210 which is engagable with plate 112. In a preferred embodiment, bevelled edges 214, 216 engage bevelled edges 112, 114 on plate 110, whereby plate 110 slides onto assembly 200, secured by set screws 218.

A plurality of elongated holes 220 are provided in assembly 210. Heaters, such as is representatively shown by partially withdrawn heater 222, are disposed within holes 220. Typically, such heaters are 100W type, although this may vary depending on the number used and the size of pad 120. Additionally, a temperature sensor 223 may be disposed within one of the holes 220. Alternatively, a temperature sensor may be attached to, or disposed in proximity to, plate 110.

A heat insulating layer 224 may be provided disposed in overlaying conformity between assembly 210 and a lower mounting assembly 226. Preferably, the insulating layer is strong to resist the great forces exerted during decoration.

Mounting assembly 226, in a preferred embodiment, includes a centrally disposed, threaded mounting aperture 228, to facilitate mounting of block 200 to the decorating apparatus. Screws 230 bind layers 210, 224, 226 together.

Accordingly, the pad of the invention is extremely rugged and durable. Projections 118 are highly resistant to wear, and serve to additionally stabilize pad 120, promoting longer life thereof. If pad 120 wears out only pad 120 and plate 112 need be replaced, removal of heating assembly 200, or its attendant electrical connections is not required, whereby downtime of the labelling machine is reduced. Moreover, heating elements 222 may be replaced without requiring removal or replacement of pad assembly 100 or block 200.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

What is claimed is:

1. Apparatus comprising:

a heater;

a separate heat conducting member engagable with said heater;

a plurality of rigid, spaced-apart heat conducting projections extending from said heat conducting member; and an elastomeric pad molded over said projections;

whereby heat is transmitted from said heater assembly to said plate and projections, thereby heating said elastomeric pad.

2. Apparatus of claim 1, further comprising:

a plurality of heat generating elements removably disposed within said heater.

3. Apparatus of claim 1, wherein said plate is provided with a fill hole through which liquid elastomeric compound is introduced to fill a mold.

4. Apparatus of claim 1, wherein said heat conducting member is a metal plate.

5. Apparatus of claim 4, wherein said plate and heater are provided with beveled edges, whereby said plate is slideably engaged in close abutting conformity with said heater assembly.

6. Apparatus of claim 5, further including:

at least one set screw of maintaining said plate in engagement with said heater.

7. Apparatus of claim 1, wherein said projections are bolts with enlarged heads.

8. Apparatus of claim 1, wherein said pad is composed of a compound resistant to heat degredation.

9. Apparatus of claim 1, wherein said pad is composed of a silicone compound.

10. Apparatus of claim 1, further comprising:

a temperature sensor cooperative with said heater.

11. Apparatus of claim 1, further comprising:

a temperature sensor cooperative with said pad.

12. Apparatus of claim 1, further comprising:

a heat insulating layer cooperative with said heater.

13. Apparatus for heat transfer labelling, comprising:

a mounting assembly;

a heat insulating layer in overlaying conformity with said mounting assembly;

a second assembly in overlaying conformity with said insulating layer, and having a plurality of elongated holes therein;

a plurality of heat generating elements disposed within said holes;

a plate having an aperture slideably engagable with said second assembly;

a plurality of elongated projections extending from said plate; and a silicone pad molded over said projections.

14. Apparatus of claim 13, further comprising:

a set screw for maintaining said plate in engagement with said second assembly.

15. Apparatus of claim 13, wherein said projections are bolts.

* * * * *